US011045925B2

(12) United States Patent
Kukucka et al.

(10) Patent No.: US 11,045,925 B2
(45) Date of Patent: Jun. 29, 2021

(54) ANTI-SLIP FASTENER REMOVER TOOL

(71) Applicant: GRIP HOLDINGS LLC, Brandon, FL (US)

(72) Inventors: Paul Kukucka, Brandon, FL (US); Thomas Stefan Kukucka, Brandon, FL (US)

(73) Assignee: GRIP HOLDINGS LLC, Brandon, FL (US)

( * ) Notice: Subject to any disclaimer, the term of this patent is extended or adjusted under 35 U.S.C. 154(b) by 24 days.

(21) Appl. No.: 16/548,470

(22) Filed: Aug. 22, 2019

(65) Prior Publication Data

US 2019/0375077 A1 Dec. 12, 2019

Related U.S. Application Data

(63) Continuation-in-part of application No. 16/514,117, filed on Jul. 17, 2019, and a continuation-in-part of application No. 16/255,341, filed on Jan. 23, 2019, application No. 16/548,470, which is a continuation-in-part of application No. 16/107,842, filed on Aug. 21, 2018, now Pat. No. 10,780,556, which is a continuation-in-part of application No. 15/601,864, filed on May 22, 2017, now abandoned, and a continuation-in-part of application No. 14/701,482, filed on Apr. 30, 2015, now abandoned.

(60) Provisional application No. 62/733,507, filed on Sep. 19, 2018, provisional application No. 62/664,559, filed on Apr. 30, 2018, provisional application No. 61/986,327, filed on Apr. 30, 2014.

(51) Int. Cl.
*B25B 15/00* (2006.01)

(52) U.S. Cl.
CPC ..... *B25B 15/005* (2013.01)

(58) Field of Classification Search
CPC ..... B25B 15/001; B25B 15/005; B25B 23/28; B25B 27/28; B25B 13/04; B25B 23/08; B25B 27/18
USPC ..... 81/461, 179, 177.75, 53.2
See application file for complete search history.

(56) References Cited

U.S. PATENT DOCUMENTS

| | | | |
|---|---|---|---|
| D776,505 | S | 1/2017 | Doroslovac |
| D784,106 | S | 4/2017 | Doroslovac |
| 9,687,968 | B2 | 6/2017 | Doroslovac et al. |
| D794,405 | S | 8/2017 | Doroslovac et al. |
| D798,682 | S | 10/2017 | Doroslovac et al. |

(Continued)

*Primary Examiner* — Monica S Carter
*Assistant Examiner* — Abbie E Quann

(57) ABSTRACT

An anti-slip fastener remover tool includes a torque-tool body and a plurality of paired engagement features. The plurality of paired engagement features that grips the lateral surface of the stripped fastener head is radially positioned around a rotation axis of the torque-tool body. The plurality of paired engagement features, wherein each paired engagement feature is offset by 30 degrees, comprises a first engagement feature and a second engagement feature. The first engagement feature and the second engagement feature each comprises a bracing section and a cavity section that are adjacently connected to each other. The cavity section of the first engagement feature is adjacently connected to the cavity section of the second engagement feature. The bracing section of the first engagement feature and the bracing section of the second engagement feature are oppositely positioned of each other about the cavity sections of the first and second engagement features.

12 Claims, 5 Drawing Sheets

(56) References Cited

U.S. PATENT DOCUMENTS

| | | | | |
|---|---|---|---|---|
| D829,069 | S | 9/2018 | Doroslovac et al. | |
| 10,081,094 | B2 | 9/2018 | Doroslovac et al. | |
| 2006/0266168 | A1* | 11/2006 | Pacheco, Jr. | B25B 13/065 81/460 |
| 2014/0260832 | A1* | 9/2014 | Hsiao | B25B 23/0035 81/438 |
| 2015/0314429 | A1 | 11/2015 | Doroslovac | |
| 2018/0354022 | A1* | 12/2018 | Ross | B21K 1/463 |

* cited by examiner

ANTI-SLIP FASTENER REMOVER TOOL

The current application is a continuation-in-part (CIP) application of a U.S. non-provisional application Ser. No. 16/514,117 filed on Jul. 17, 2019. The U.S. non-provisional application Ser. No. 16/514,117 claims priority to a U.S. nonprovisional application Ser. No. 16/255,341 filed on Jan. 23, 2019. The U.S. non-provisional application Ser. No. 16/255,341 claims a priority to a U.S. provisional application Ser. No. 62/733,507 filed on Sep. 19, 2018.

The current application is a continuation-in-part (CIP) application of a U.S. non-provisional application Ser. No. 16/107,842 filed on Aug. 21, 2018.

FIELD OF THE INVENTION

The present invention relates generally to tools designed for tightening or loosening fasteners, in particular bolts and nuts. More specifically, the present invention is an anti-slip fastener remover tool that designed to engaged bolts, nuts, and other similar fasteners with little chance of slippage.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head portion that is connected at one end of the cylindrical shaft. The external thread engages a complimentary female thread tapped into a hole or a nut and secures the fastener in place, fastening the associated components together. The head portion receives an external torque force and is the means by which the fastener is turned, or driven, into the female threading. The head portion is shaped specifically to allow an external tool like a wrench to apply a torque to the fastener in order to rotate the fastener and engage the complimentary female threading to a certain degree. This type of fastener is simple, extremely effective, cheap, and highly popular in modern construction. One of the most common problems in using these types of fasteners, whether male or female, is the tool slipping in the head portion, or slipping on the head portion. This is generally caused by either a worn fastener or tool, corrosion, overtightening, or damage to the head portion of the fastener. Various methods may be used to remove a fastener, some more aggressive than others. Once a fastener head is damaged, a more aggressive method must be implemented to remove a seized fastener. Drilling out the fastener is a common method used by some users to dislodge the fastener. While this method can prove to be effective in some scenarios there is a high risk of damaging the internal threads of the hole.

The present invention is an anti-slip fastener remover tool that virtually eliminates the chance of slippage. The present invention uses a series of integrated engagement segments that bite into the head portion of the fastener and allow for efficient torque transfer between the extractor bit and the head portion of the fastener. Resultantly, the present invention may be used to tighten or loosen fasteners without worrying about stripping the corners of the fastener.

DETAIL DESCRIPTIONS OF THE INVENTION

Figure 1:
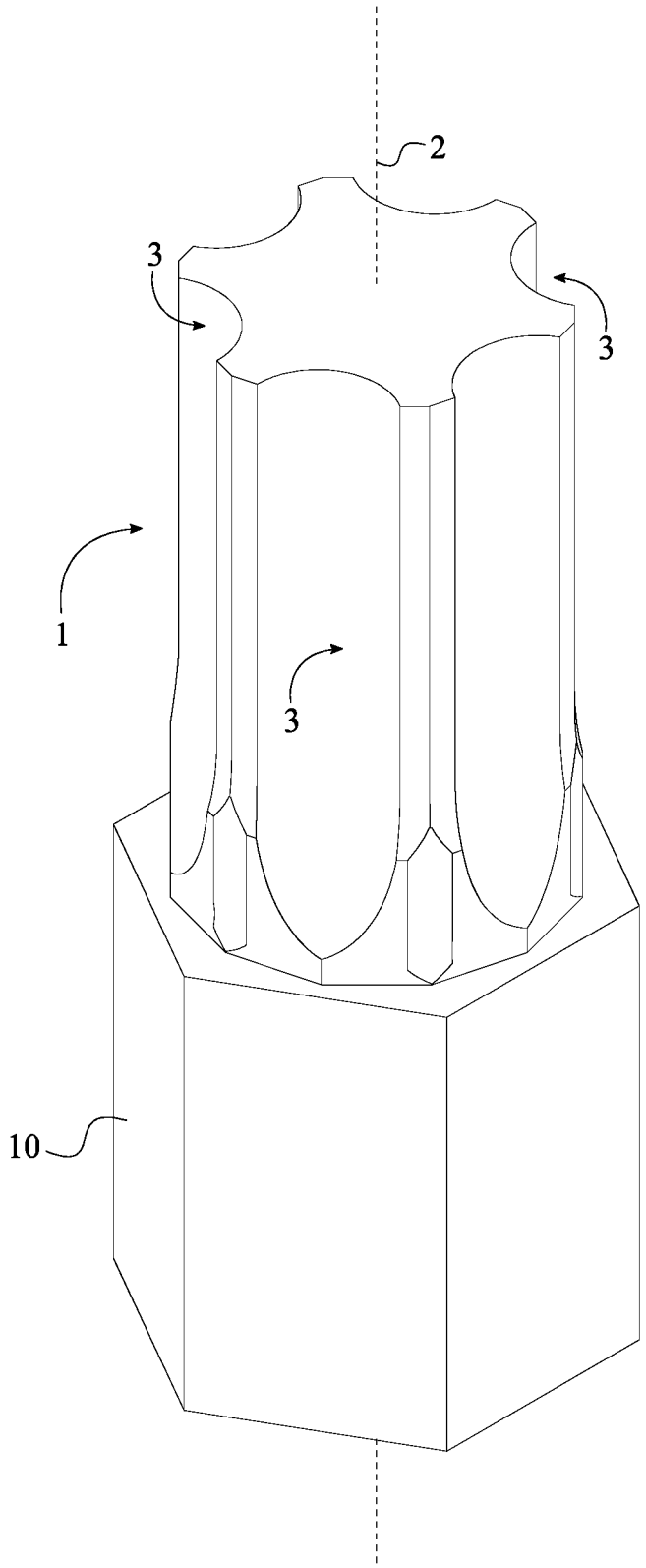
FIG. 1 is a perspective view of the present invention, wherein the torque-tool body is outwardly extended from the rotational axis to the plurality of paired engagement features.
Figure 2:
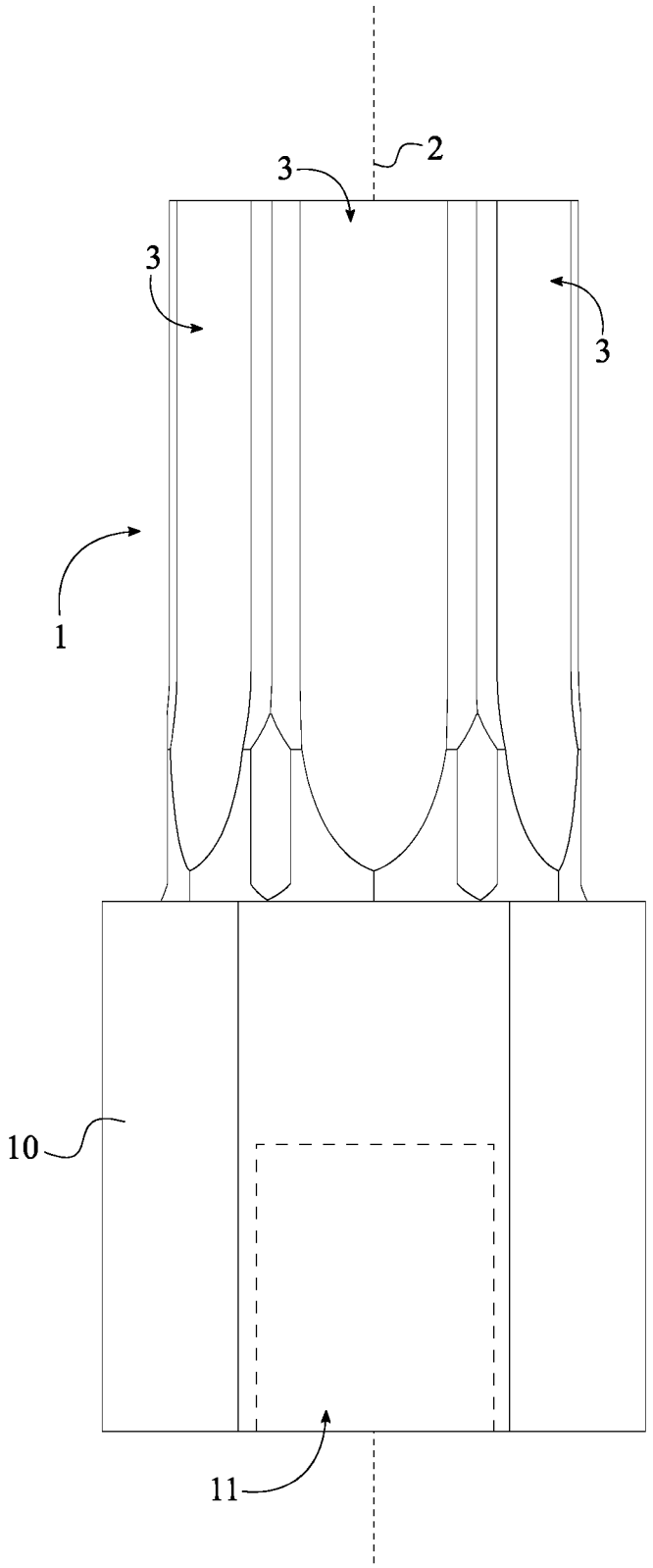
FIG. 2 is a side view of the present invention, wherein the torque-tool body is outwardly extended from the rotational axis to the plurality of paired engagement features.
Figure 3:
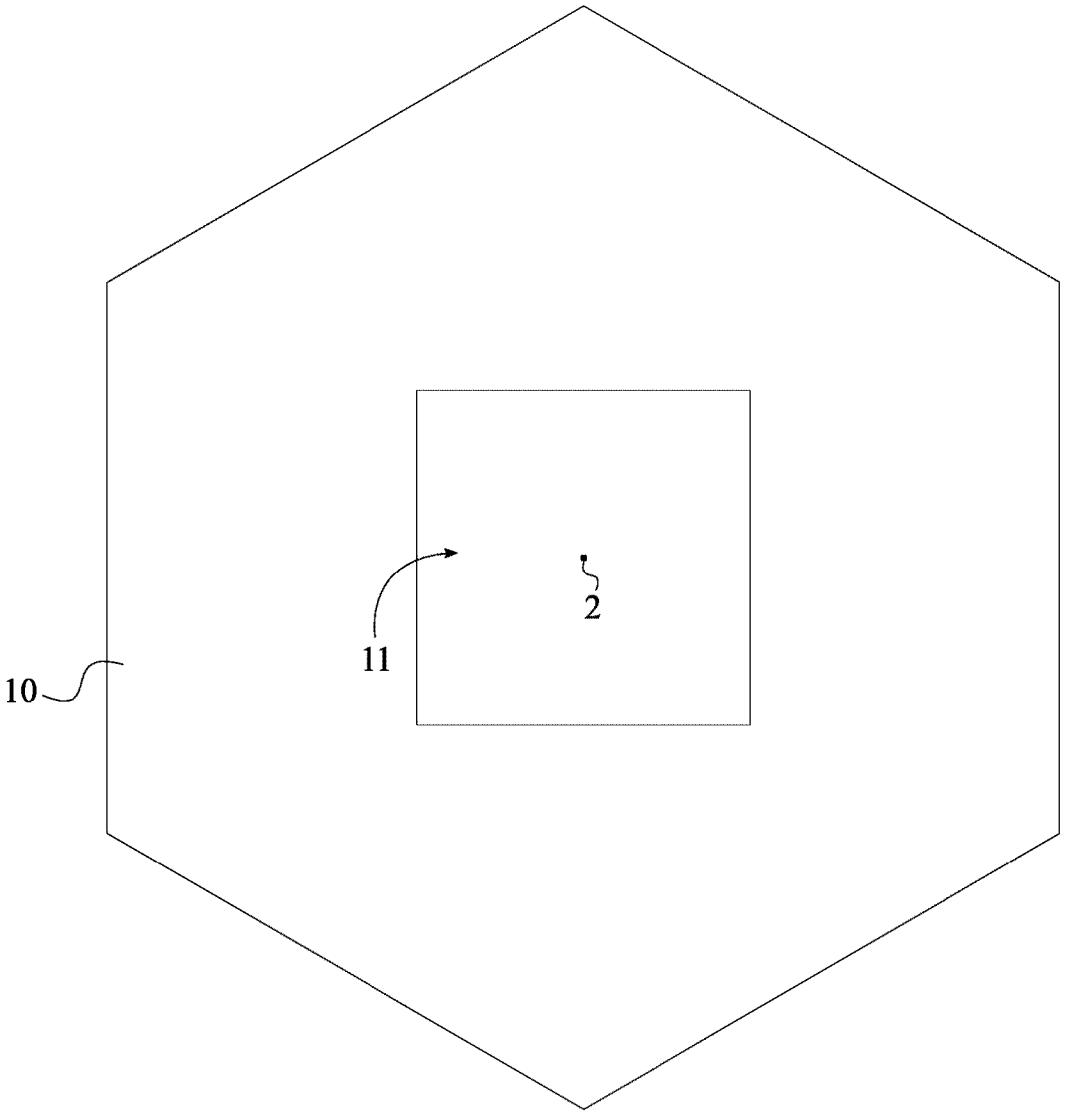
FIG. 3 is a bottom view of the present invention, wherein the torque-tool body is outwardly extended from the rotational axis to the plurality of paired engagement features.

All illustrations of the drawings are for the purpose of describing selected versions of the present invention and are not intended to limit the scope of the present invention.

The present invention is an anti-slip tool used to tighten or loosen a damaged/stripped fastener such as a nut or bolt. Traditional wrench designs transfer the majority of the torque to the damaged/stripped fastener through the lateral corners of the fastener head. Over time, the degradation of the lateral corners reduces the efficiency of transferring torque from the wrench to the fastener head and, as a result, causes slippage. The present invention overcomes this problem by moving the contact point to the lateral sides of the fastener head. This is accomplished through the use of a multitude of teeth. Each of the teeth is positioned to engage or "bite" the lateral surface of the fastener head instead of the lateral corner. This ensures an adequate amount of torque is transferred to the fastener head to initiate rotation and, resultantly, extraction or tighten the damaged/stripped fastener. However, the present invention is also designed to be used with an undamaged or new fastener without causing damage to the fastener when torque is applied in accordance with maximum specified and industry approved torque levels for the particular fastener size or diameter.

The present invention utilizes a multitude of teeth to engage the sides of the fastener head, damaged or otherwise, in order to efficiently apply torque onto the damaged/stripped fastener. The present invention may be integrated into or utilized by a variety of general tools to increase the torque force applied to a fastener. General tools include, but are not limited to, open-end wrenches, adjustable wrenches, pipe wrenches, socket wrenches, plumber wrench, and other similar fastener engaging tools. The present invention is compatible with female-member based head designs of fasteners. Fasteners which utilize a female-member head design, also known as female fasteners, use the internal lateral surface or the internal cavity of the fastener head to engage a tool for tightening or loosening. In addition, the present invention is compatible with fasteners of a right-hand thread and fasteners of a left-hand thread. Furthermore, the present invention may be altered and configured to fit different types and different sizes of fasteners.

Referring to FIG. 1-5, the present invention comprises a torque-tool body 1 and a plurality of paired engagement features 3. The torque-tool body 1 is used as the physical structure to apply the corresponding force by the plurality of paired engagement features 3 on the fastener head. For some fasteners, the torque-tool body 1 functions similar to a driver-bit that is sized to fit into an opening of the fastener head in an interlocking manner. The length, width, and diameter of the torque-tool body 1 may vary to fit different sized male/female fasteners. The plurality of paired engagement features 3 prevents slippage during the damaged/stripped fastener extraction and is radially positioned around a rotational axis 2 of the torque-tool body 1 as seen in FIG. 1-4. As a result, the plurality of paired engagement features 3 facilitates the transfer of torque to the male/female fastener by preventing slippage between the torque-tool body 1 and the fastener head.

The plurality of paired engagement features 3 is distributed into a polygon shape within the torque-tool body 1 and preferably symmetric along the rotational axis 2, wherein the rotational axis 2 centrally traverses through the torque-tool body 1. A symmetrical design is ensured within the present invention to performs equally when rotating the fastener in a clockwise direction or in a counterclockwise direction.

In reference to FIG. 1, the torque-tool body 1 is outwardly extended from the rotational axis 2 to the plurality of paired engagement features 3. This yields the driver-bit structure for the present invention as the plurality of paired engagement features 3 is distributed about the rotational axis 2 on an external surface of the torque-tool body 1. The driver-bit structure of the torque-tool body 1 associates with the opening of the fastener head so that the plurality of paired engagement features 3 can internally engaged with the fastener head.

The present invention also incorporates an attachment feature which allows an external torque applying tool to attach to the torque-tool body 1 and increase the torque force applied to the fastener head. In reference to FIG. 2-3, the present invention further comprises an attachment body 10 and an engagement bore 11 that allow an external torque applying tool such as an open ended wrench, a box ended wrench, a combination wrench, an adjustable wrench, and a socket wrench to be attached to the torque-tool body 1. The attachment body 10 is centrally positioned around and along the rotational axis 2 in order to align with the axis of rotation of the external torque applying tool. Furthermore, the attachment body 10 is connected adjacent to the torque-tool body 1. The attachment body 10 is preferably of a hexagonal shaped body with a diameter preferably and slightly larger than the diameter for the torque-tool body 1. However, the attachment body 10 may incorporate a smaller diameter than the torque-tool body 1 depending upon the preferred manufacturing method or design. The engagement bore 11 traverses into the attachment body 10 along the rotational axis 2. The engagement bore 11 is shaped to receive a male attachment member of a socket wrench, wherein the preferred shape of the engagement bore 11 is a square as the majority of socket wrenches utilize a square male attachment member. In alternative embodiments, the shape and design of the engagement bore 11 and the attachment body 10 may vary to be adaptable to different torque applying tools and different attachment means including, but not limited to, square or cylindrical. In an alternative embodiment, an outer surface of the attachment body 10 may have surface griping treatment applied such as knurling or other alternative methods to increase the friction between torque-tool body 1 and the user's hand.

A bottom surface of the attachment body 10 is tapered away from the engagement bore 11 so that the plurality of paired engagement features 3 can be driven into the damaged/stripped fastener head by a hammer, without hitting or damaging the engagement bore 11. In other words, a diameter of the attachment body 10 about the engagement bore 11 is slightly larger than a diameter of the attachment body 10 about the torque-tool body 1 so that the bottom surface of the attachment body 10 can be tapered away from the engagement bore 11. In some embodiments of the present invention, the attachment body 10 may not comprises the engagement bore 11 as the attachment body 10 itself functions as the engagement feature between the present invention and the external torque force.

Additionally, a wrench handle can be peripherally connected to the torque-tool body 1, wherein the wrench handle functions as the external torque applying tool. With respect to the wrench handle, each of the plurality of paired engagement features 3 is extended along a specific length of the torque-tool body 1 thus delineating an empty space within the torque-tool body 1. The aforementioned empty space functions as a receptive cavity for the fastener head so that the plurality of paired engagement features 3 can grip the lateral surface of the fastener head. The present invention further comprises a fastener-receiving hole that traverses through the torque-tool body 1. The fastener-receiving hole, perpendicular to the rotational axis 2, is positioned opposite the wrench handle and across the torque-tool body 1 thus providing a lateral opening to engage the plurality of paired engagement features 3.

The attachment body 10 can also incorporate a quick connect feature that is typically used in drills, impact drivers, and screw attachment.

Figure 4:
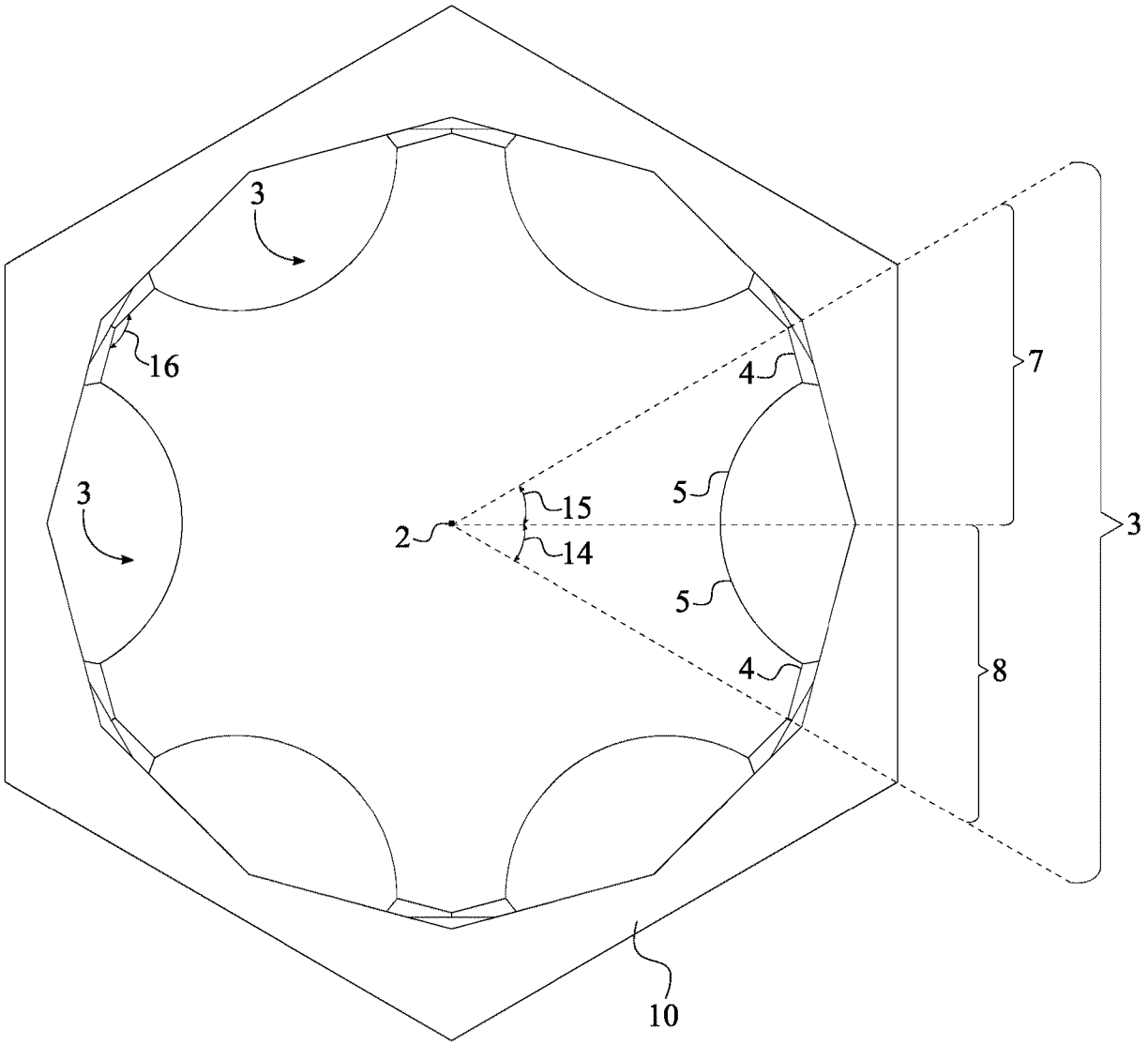
FIG. 4 is a top view of the present invention, wherein the torque-tool body is outwardly extended from the rotational axis to the plurality of paired engagement features.

The plurality of paired engagement features 3 is equally spaced about the torque-tool body 1 to create an enclosed profile as seen in FIG. 4. In order to configure the enclosed profile, the plurality of paired engagement features 3 comprises a first engagement feature 7, a second engagement feature 8, and a bisecting line 6. The first engagement feature 7 and the second engagement feature 8 alternate within the enclosed profile to become intermittent depending on the rotation direction of the tool. The bisecting line 6 separates the first engagement feature 7 and the second engagement feature 8 into equal sections within each of the plurality of paired engagement features 3.

Furthermore, a cross section for the first engagement feature 7 and a second engagement feature 8 each comprises a bracing section 4 and a cavity section 5 as shown in FIG. 4. More specifically, the bracing section 4 and the cavity section 5 are adjacently connected to each other thus delineating a single engagement feature that cuts into the fastener head during the removal of the damaged/stripped fastener. A top surface of the torque-tool body 1 and the bottom surface of the attachment body 10 are positioned opposite of each other across the plurality of paired engagement features 3, wherein the top surface and the bottom surface are configured as flat surfaces.

The length of the bracing section 4 and the cavity section 5 and the corresponding angles between the bracing section 4 and the cavity section 5 may vary to create a sharper tooth-like shape for the engagement feature. The first engagement feature 7 is any feature within the plurality of paired engagement features 3 in such a way that the second engagement feature 8 is the feature directly next to the first engagement feature 7 within corresponding the plurality of paired engagement features 3. More specifically, the cavity section 5 of the first engagement feature 7 is adjacently connected to the cavity section 5 of the second engagement feature 8. The cavity section 5 of the first engagement feature 7 and the cavity section 5 of the second engagement feature 8 are oriented towards the rotational axis 2 thus collectively delineating a circular shaped profile. The bracing section 4 of the first engagement feature 7 and the bracing section 4 of the second engagement feature 8 are oppositely positioned of each other about the cavity section 5 of the first engagement feature 7 and the cavity section 5 of the second engagement feature 8. In other words, the cavity section 5 of the first engagement feature 7 and the cavity section 5 of the second engagement feature 8 are adjacently positioned in between the bracing section 4 of the first engagement feature 7 and the bracing section 4 of the second engagement feature 8.

A first length ratio between the bracing section 4 of the first engagement feature 7 and the cavity section 5 of the first engagement feature 7 is 1:1.5 to 3.5. A second length ratio between the bracing section 4 of the second engagement feature 8 and the cavity section 5 of the second engagement feature 8 is 1:1.5 to 3.5. More specifically, in some embodiment, the first length ratio and the second length ratio can be 1:2. In some embodiment, the first length ratio and the second length ratio can be 1:3.

The present invention further comprises a first connection point and a second connection point, More specifically, the first connection point is delineated as the meeting point of the cavity section 5 and the bracing section 4 of the first engagement feature 7, and the second connection point is delineated as the meeting point of the cavity section 5 and the bracing section 4 of the second engagement feature 8.

Figure 5:
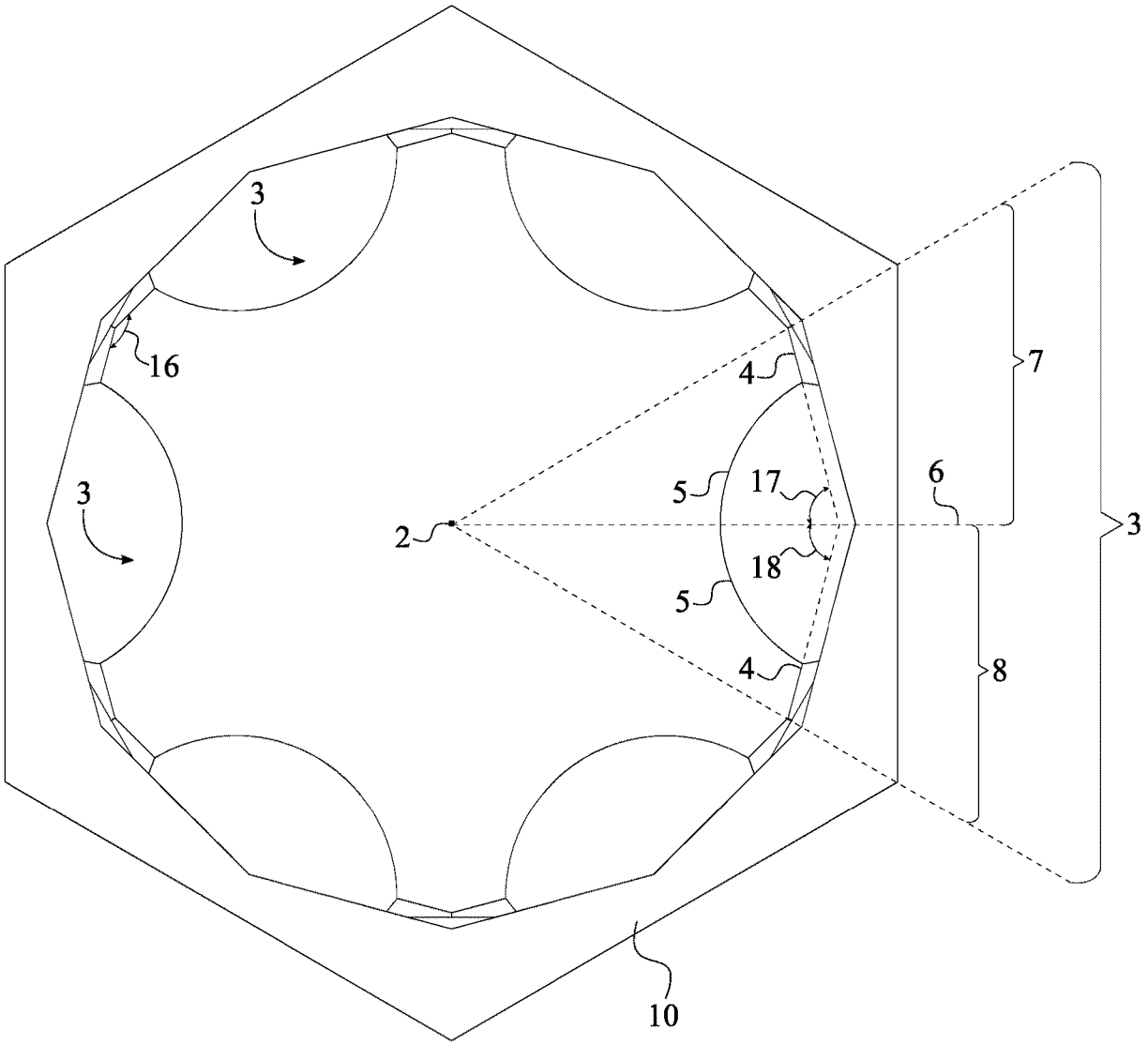
FIG. 5 is a top view of the present invention, wherein the torque-tool body is outwardly extended from the rotational axis to the plurality of paired engagement features and showing the bisecting line, the first bisecting angle, and the second bisecting angle.

Furthermore, a first bisecting angle 17 of the present invention is delineated between the first connection point and the bisecting line 6 as shown in FIG. 5. Depending upon different embodiment of the present invention, the first bisecting angle can be an acute angle, a right angle, and an obtuse angle.

Furthermore, a second bisecting angle 18 of the present invention is delineated between the second connection point and the bisecting line 6 as shown in FIG. 5. Depending upon different embodiment of the present invention, the second bisecting angle can be an acute angle, a right angle, and an obtuse angle.

Furthermore, the first bisecting angle 17 and the second bisecting angle 18 are collectively combined into a 180 degree angle when an imaginary straight line is draw in between the first connection point and the second connection point.

Furthermore, the first bisecting angle 17 and the second bisecting angle 18 are collectively combined into an angle less than 180 degrees when a first imaginary line is draw parallel to the bracing section 4 of the first engagement feature 7 and intersected through the first connection point, and a second imaginary line is draw parallel to the bracing section 4 of the second engagement feature 8 and intersected through the second connection point.

Furthermore, the bracing section 4 of the first engagement feature 7 and the bracing section 4 of the second engagement feature 8 are positioned offset of each other. More specifically, the present invention further comprises a first geometric plane and a second geometric plane. The first geometric plane is positioned parallel to the bracing section 4 of the first engagement feature 7, and the second geometric plane that is positioned parallel to the bracing section 4 of the second engagement feature 8 as the first geometric plane and the second geometric plane are positioned offset of each other. In other words, the first geometric plane and the second geometric plane are not co-planer within the present invention. Specifically, the bracing section 4 of the first engagement feature 7 and the bracing section 4 of the second engagement feature 8 are not aligned with each other.

Preferably, the number of the plurality of paired engagement features 3 in contact with the fastener head is six as the six paired engagement features 3 is equal to 12 single engagement features. In reference to FIG. 4, a first angle 14 between the first engagement feature 7 is 30 degrees and a second angle 15 between the second engagement feature 8 is 30 degrees. Furthermore, a third angle 16 between each of the plurality of paired engagement features 3 ranges between 121-179 degrees. As a result, an angular orientation between each of the plurality of paired engagement features 3 can be changed according to different embodiments of the present invention. More specifically, some embodiment of the present invention, the third angle 16 can be 130 degrees. Some embodiment of the present invention, the third angle 16 can be 135 degrees. Some embodiment of the present invention, the third angle 16 can be 145 degrees. Some embodiment of the present invention, the third angle 16 can be 150 degrees.

In some embodiments of the present invention, the plurality of paired engagement features 3 can be tapered away from the rotational axis 2. In other words, an outer diameter of the plurality of paired engagement features 3 about the top surface of the torque-tool body 1 is smaller than an outer diameter of the plurality of paired engagement features 3 about the attachment body 10. Additionally, the cavity section 5 of the first engagement feature 7 and the cavity section 5 of the second engagement feature 8 become narrower and shallower from the top surface of the torque-tool body 1 to the attachment body 10. Even though the cavity section 5 of the first engagement feature 7 and the cavity section 5 of the second engagement feature 8 collectively delineate a circular shaped profile, the present invention is not limited to the circular shaped profile and can be other type of geometric shapes. For example, the cavity section 5 of the first engagement feature 7 and the cavity section 5 of the second engagement feature 8 can delineate a triangular shaped profile within the corresponding bracing sections 4.

To remove the damaged/stripped fastener with the present invention, the torque-tool body 1 is positioned within the damaged/stripped fastener so that a significant portion of the plurality of paired engagement features 3 is positioned within the fastener head. The user then simply applies a counter-clockwise torque force to the torque-tool body 1 in order to rotate and remove the damaged/stripped fastener. When a torque force is applied to the torque-tool body 1, the plurality of paired engagement features 3 "bite" into the lateral sides of fastener head which in turn rotates the damaged/stripped fastener. The present invention is designed to engage partially or fully stripped fastener heads. The present invention overcomes slippage of the fastener head through the use of the plurality of paired engagement features 3.

The present invention is able to drive a fastener on cavity section 5 of the first engagement feature 7 and the cavity section 5 of the second engagement feature 8 in a corresponding lobular fastener design such as Torx, as well as drive a fastener on the outer bracing surface of a socket fastener through the bracing sections 4 of the first engagement feature 7 and bracing sections 4 of the second engagement feature 8.

Although the invention has been explained in relation to its preferred embodiment, it is to be understood that many other possible modifications and variations can be made without departing from the spirit and scope of the invention as hereinafter claimed.

What is claimed is:

1. An anti-slip fastener remover tool comprises:

a torque-tool body;

a plurality of paired engagement features;

each of the plurality of paired engagement features comprising a first engagement feature and a second engagement feature;

a cross section for the first engagement feature and the second engagement feature each comprising a bracing section and a cavity section;

the plurality of paired engagement features being radially distributed about a rotational axis of the torque-tool body;

the bracing section and the cavity section being adjacently connected to each other so as to form a sharp tooth in between the bracing section and the cavity section;

the sharp tooth being configured to engage, cut or bite a surface of a fastener head;

the cavity section of the first engagement feature being adjacently connected to the cavity section of the second engagement feature;

the cavity section of the first engagement feature and the cavity section of the second engagement feature being oriented towards the rotational axis;

the bracing section of the first engagement feature and the bracing section of the second engagement feature each being straight or flat; and the bracing section of the first engagement feature and the bracing section of the second engagement feature being oppositely positioned of each other about the cavity section of the first engagement feature and the cavity section of the second engagement feature;

wherein a first geometric plane positioned parallel to the bracing section of the first engagement feature and a second geometric plane positioned parallel to the bracing section of the second engagement feature are not co-planer, such that the bracing section of the first engagement feature and the bracing section of the second engagement feature are not aligned with each other.

2. The anti-slip fastener remover tool as claimed in claim 1, wherein a first angle between the first engagement feature is 30 degrees, and wherein a second angle between the second engagement feature is 30 degrees.

3. The anti-slip fastener remover tool as claimed in claim 1, wherein a third angle between each of the plurality of paired engagement features ranges between 121-179 degrees.

4. The anti-slip fastener remover tool as claimed in claim 3, wherein the third angle is 130 degrees.

5. The anti-slip fastener remover tool as claimed in claim 3, wherein the third angle is 135 degrees.

6. The anti-slip fastener remover tool as claimed in claim 3, wherein the third angle is 145 degrees.

7. The anti-slip fastener remover tool as claimed in claim 3, wherein the third angle is 150 degrees.

8. The anti-slip fastener remover tool as claimed in claim 1 comprising:

the torque-tool body being outwardly extended from the rotational axis to the plurality of paired engagement features.

9. The anti-slip fastener remover tool as claimed in claim 1, wherein a first length ratio between the bracing section of the first engagement feature and the cavity section of the first engagement feature is 1:1.5 to 3.5.

10. The anti-slip fastener remover tool as claimed in claim 1, wherein a second length ratio between the bracing section of the second engagement feature and the cavity section of the second engagement feature is 1:1.5 to 3.5.

11. The anti-slip fastener remover tool as claimed in claim 1, wherein the bracing section of the first engagement feature and the bracing section of the second engagement feature are positioned offset of each other.

12. The anti-slip fastener remover tool as claimed in claim 1 comprises:

an attachment body;

an engagement bore;

the attachment body being centrally positioned around and along the rotational axis;

the attachment body being adjacently connected to the torque-tool body; and the engagement bore traversing into the attachment body along the rotational axis, opposite of the torque-tool body.

* * * * *